US006769688B1

(12) United States Patent
Lean

(10) Patent No.: US 6,769,688 B1
(45) Date of Patent: Aug. 3, 2004

(54) LUCKY SPIN DICE CASINO GAME

(76) Inventor: Prasoeur Lean, P.O. Box 6729, San Pablo, CA (US) 94806

( * ) Notice: Subject to any disclaimer, the term of this patent is extended or adjusted under 35 U.S.C. 154(b) by 0 days.

(21) Appl. No.: 10/397,921

(22) Filed: Mar. 26, 2003

(51) Int. Cl.[7] ..... A63F 5/04
(52) U.S. Cl. ..... 273/146; 273/138.1; 273/148 R
(58) Field of Search ..... 273/146, 288, 273/148 R, 147, 138.1; D21/372, 373

(56) References Cited

U.S. PATENT DOCUMENTS 2,794,644 A * 6/1957 Johnson ..... 273/147
2,976,045 A * 3/1961 Mason ..... 273/269
6,565,088 B2 * 5/2003 Perrie et al. ..... 273/146

* cited by examiner

*Primary Examiner*—Vishu Mendiratta
(74) *Attorney, Agent, or Firm*—Donald W. Meeker

(57) ABSTRACT

A dice game is provided that has a dice mounted on a vertical central shaft for spinning the dice. The dice piece has a top and bottom surface, a circular perimeter, a vertical center hole through the dice piece from top to the bottom surface and a series of adjacent different number bearing faces positioned vertically around its perimeter. The vertical shaft is friction fit and slidably adjustable within the vertical center hole, protruding on each end of the dice. One end of the shaft is for the player to grasp and spin, the other for the dice to spin upon. The adjustable shaft provides variations to the spin and balance properties of the system. The system also includes a smooth horizontal spinning surface, a cover removably placeable over the spinning surface, a sound absorbing container below the horizontal spinning surface, and a betting surface.

5 Claims, 5 Drawing Sheets

LUCKY SPIN DICE CASINO GAME

BACKGROUND OF THE INVENTION

1. Field of the Invention

The present invention relates to games and more particularly wagering games using a spinning and rolling dice with a center spinning post to provide random outcomes and a betting board to bet on the outcomes.

2. Description of the Prior Art

Dice, in various forms, and games involving dice have been used throughout the world for thousands of years. Archaeologists have found six-sided dice, similar in appearance to those used today, in Egyptian ruins dating back to 600 B.C. Even earlier references have been found in India, which is believed to be where dice originated. Dice were believed to have mystical powers and were used to predict the future. There are also references to gambling on dice dating back at least 2,000 years. In fact, the Bible makes reference to "casting lots," and when Caesar crossed the Rubicon, against the edict of Rome, he is reported to have said, "Tracta alea est" ("The die is cast").

The present day version of one game involving gambling on dice, typically referred to as craps, has been played for most of the last 100 years. The game enjoyed great popularity with the troops during World War II. The banked version of craps, as played in casinos, was very popular in the years immediately following the war. Basically, the banked version of craps involves rolling two dice on a typical "tub table," which is a table with vertical walls and an upright wooden raft running around its outside edge. The table is generally attended by dealers and boxmen, one of whom may be known as a "stickman." The table surface is generally covered with cloth printed with designs enabling the placing of bets by the shooter and players. The dice are thrown after the person throwing the dice, the "shooter," makes a bet that he or she will pass or win. Other players may place bets as well. Generally, the shooter and players win immediately if a 7 or 11 is rolled on the first roll, and lose immediately if a 2, 3, or 12 is rolled. If any other total (4, 5, 6, 8, 9 or 10) is rolled, that total becomes the shooter's "point" and he or she continues rolling until winning by rolling the point again, or losing by rolling a seven. Players do not gamble against each other rather, all bets are made against the house. Chips or other markers are generally used to indicate the placing of a wager on a board indicating the various betting options and odds.

Most of the prior art patents relate to the traditional dice that are held in the hand and rolled or to devices that roll the dice.

Prior art U.S. Pat. No. 5,732,948, issued Mar. 3, 1998 to Yoseloff, provides a dice wagering game method involving rolling two standard six-sided dice either manually or electronically, wherein a least one wager is placed and the two dice are rolled a first time to yield a total count of one of the counts of two through twelve inclusive. If a seven total is rolled the wager is resolved by paying a player a multiple of the amount of the wager and the game is terminated, but if any other total is rolled, that total and its equal-odds pair total are designated as point numbers, and the game is continued by rolling two dice a second time. If a seven total is rolled, the wager is resolved by returning the wager to the player, and the game is terminated, and if a total equal to a designated point number is rolled, the wager is resolved by paying the player an equal or higher multiple of the amount of the wager, and the game is terminated. If a total not equal to seven or a designated point number is rolled, the wager is resolved by forfeiture, and the game is terminated.

Prior art U.S. Pat. No. 6,406,022, issued Jun. 18, 2002 to Nadibaidze, shows a method of mass amusement that uses the stake field simulating a roulette-type betting field with various-color stake squares with various-color information marks from 1 to 36 formed thereupon and the twelve Zodiac signs in the stake squares with digital information marks 1, 2, 3, 5, 7, 11, 13, 17, 19, 23, 29, and 31. Also formed is a flat image of a stationary roulette wheel having 36 main sectors and one or two additional sectors, with each main sector to contain, first, the images of digits from 1 to 36 with the images of the twelve Zodiac signs in the places of location of the prime numbers 1, 2, 3, 5,7, 11, 13, 17, 19, 23, 29, and 31, and, secondly, two images of the hexagonal die with information marks being various number of spots: from one to six. Then, the players place their bets on the stake squares of the stake field, the procedure to be followed by choosing two pairs of random gambling indices by means of double simultaneous casting of two hexagonal dice.

Prior art U.S. Pat. No. 5,806,847, issued Sep. 15, 1998 to White, claims a game of chance that has a playing surface which includes a plurality of betting areas. The betting areas have a plurality of betting squares for wagering upon a selected result produced by a random result selector such as dice. In one embodiment, the random result selector comprises a plurality of dice having a plurality of faces; each face embossed with either a number or a special symbol. Each betting square contains result indicators that correspond to a selected one of the plurality of results. In addition, each betting square contains payoff indicator that indicates the payoff associated with a winning wager on the selected betting square. A single random result leads to a final and unequivocal outcome of all bets made on all betting squares. The playing surface is adapted to be placed over existing casino equipment, or may be used alone.

Prior art U.S. Pat. No. 6,273,423, issued Aug. 4, 2001 to Promutico, describes a novel game and board or surface that is played in combination with two sets of playing pieces consisting of three dice each, one set being visibly distinguishable from the second set and wherein in one embodiment all bets are placed on the board or surface before the first set of dice is throw to speed up the method of play and payoffs for each bet are set by the house. Optionally, the house may set and take additional bets between a throw of the first set of dice and a throw of the second set of dice. In another embodiment of the invention, players use the two sets of dice in sequence wherein winning bets are related to poker hands such as open numbers from 3–35; 3 of a kind; 4 of a kind; 5 of a kind, straight; any 3 pair; 6 of a kind, and six sixes (but specifically excluding two of a kind to provide decisive winning odds for the house) and where the payoffs for each bet are 2 for 1, 3 for 1, 4 for 1, 5 for 1, 8 for 1, 8 for 1, 12 for 1, and 20 for 1, respectively, for example. In yet another embodiment of the invention, odds for all bets are again set by the house and a defined whole or percentage of the remaining losing bets form a progressive pot for 6 of a kind and/or six sixes comprises part of the betting.

Prior art U.S. Pat. No. 6,234,482, issued May 22, 2001 to Henderson, discloses a dice game that utilizes three dice and begins with players making at least one of a single roll wager or a multiple roll wager. Single roll wagers are resolved after each roll of the dice. The single roll wagers include group wagers in which players wager on mutually exclusive groups of sums, each group having substantially the same probability of winning. Multiple roll wagers may require several rolls of the dice to be resolved because, if the number rolled is neither a predetermined losing outcome nor the outcome wagered upon, the wager is neither collected nor paid and an additional roll is required to resolve the wager. A shooter shoots the dice and the numbers facing upward on the dice are noted. Additionally, the numbers are summed. The wagers are then resolved. A jackpot wager is available to the shooter without the shooter making any additional wager. The shooter wins the jackpot by rolling a predetermined combination of numbers in a predetermined sequence of at least two consecutive rolls of the dice.

Prior art U.S. Pat. No. 5,259,618, issued Nov. 9, 1993 to Ramos, indicates a lockable dice cup for using in games of chance. The dice cup is comprised of a transparent cylindrical wall that attaches a receiver base to form a chamber for containing the dice. A locking mechanism is provided and comprises a tamperproof set screw having an end that lockably engages the cylindrical wall to capture the dice within the chamber and thereby prevent unauthorized dismounting of the wall from the receiver base.

Prior art U.S. Pat. No. 4,371,165, issued Feb. 1, 1983 to Tammen, puts forth a game of chance that includes a game board with a plurality of sections thereon, wherein the sections are labeled with various indicia, or combinations thereof, and odds pertaining thereto. A chance indicator device for simultaneously selecting one such indicia and a game command. The device includes two sections rotatably joined together, wherein one section is friction fit about a shaft so that it cannot rotate relative thereto, and the other section is rotatably mounted to the shaft. Both sections are identically shaped so that they may be interchangeably mounted on the shaft either by themselves or in combination, one section containing indicia on its faces and the other section containing game commands on its faces. The device is spun on the game board so as to select the indicia and/or game commands.

Prior art U.S. Pat. No. 6,158,738, issued Dec. 12, 2000 to Van Buskirk, concerns a die that generates higher values of random numbers. The die for generating a randomly occurring number between 1 and X comprises: a central body which has a lateral cross section which is an x sided polygon having sides of equal length when cut perpendicularly anywhere along a longitudinal axis. A number ranging between 1 and x is marked on an upper portion of the die when the die is resting on a lateral side, said number designating the side on which the die is resting.

Prior art U.S. Pat. No. 4,299,392, issued Nov. 10, 1981 to Tammen, illustrates a game of chance that includes a game board with a plurality of sections thereon, wherein the sections are labeled with various indicia, or combinations thereof, and odds pertaining thereto. A chance indicator device for simultaneously selecting one such indicia and a game command. The device includes two sections rotatably joined together, wherein one section is friction fit about a shaft so that it cannot rotate relative thereto, and the other section is rotatably mounted to the shaft. Both sections are identically shaped so that they may be interchangeably mounted on the shaft either by themselves or in combination, one section containing indicia on its faces and the other section containing game commands on its faces. The device is spun on the game board so as to select the indicia and/or game commands.

Prior art U.S. Pat. No. 5,848,936, issued Dec. 15, 1998 to Morrison, is for a method and device for playing a game which includes a spinning top to make random selections of outcomes. Players can wager on one or more color outcomes being generated by the top. When wagers have been made, a player spins the top which topples over to select an outcome. The dealer inputs the outcome to a processor that drives displays to display the outcome and input the current outcome on a display column showing the history of outcomes. Players are paid for winning wagers and are paid greater rewards for wagering on and obtaining consecutive same color outcomes.

Prior art U.S. Pat. No. 4,856,784, issued Aug. 15, 1989 to Magee, provides a casino type game that includes a plurality of distinguishable sets of playing pieces with a multiplicity of pieces in each set. A spinnable unitary solid brass top member includes a central section including an even number and at least four faces disposed around the periphery thereof with uniform angularity between adjoining faces and opposite faces being substantially parallel. Each face of the central section is inscribed with a legend of "put", "take" or "lose spin" and different legends are on adjoining faces. A tapered pointed section is at one end of the central section. Cylindrical gripping mechanism extends axially from an opposite end of the central section remote from the pointed section. A shiny tightly adherent uniform continuous precious metal coating is over the exterior surface of the top member.

Prior art U.S. Pat. No. 4,834,372, issued May 30, 1989 to Velazquez, shows a top device that is designed for determining chance by spinning it. Primarily, it consists of a body with a lower pointed end and a polygonal shaped upper end that receives a hexagonal pencil that is retained in a tapered hexagonal and vertical opening by friction, and the pencil is employed as a shaft for rotating or spinning the device when employed for chance determining endeavors, while in the alternative the pencil can be removed for writing.

Prior art U.S. Pat. No. D21,753, issued Aug. 2, 1892 to Huntoon, claims the ornamental design of a spinning top that has a hexagonal band encircling its body. Each face of the band is embellished to simulate the sides of a dice.

Prior art U.S. Pat. No. D31,017, issued Jun. 13, 1899 to Seiler, describes the ornamental design of a top. The conical part of the body portion is provided with a plurality of facets, six of which are employed. The facets are each provided with dots or characters ranging from one to six in number.

Prior art U.S. Pat. No. 1,321,589, issued Nov. 11, 1919 to Behringer, discloses a top that comprises a stem having an octagonal body fixedly mounted centrally thereon. The sides of the body are varicolored; the sides opposite each other are colored the same. The top also provides means to play using numbers or distinctively colored dots.

Prior art U.S. Pat. No. 1,374,243, issued Apr. 12, 1921 to Siegel, indicates a pair of dice mounted upon a rotatable stem and having their peripheries if the same diameter and of the same polygonal form. The six flat sides furnish spaces for inscribing upon each of the rotary dice the same six numbers that are found upon the six sides of a cubical dice.

Prior art U.S. Pat. No. 1,529,263, issued Mar. 10, 1925 to McGinnis, puts forth a game device that is similar to a top. The oblong body portion is provided with a plurality of longitudinal faces, each face having the name of a card.

Prior art U.S. Pat. No. 1,546,451, issued Jul. 21, 1925 to Meyers, concerns a game top adapted for spinning on a flat surface and so arranged and constructed as to afford means for playing a game. The sides of the main body upon which is, in the present instance, the names of race horses or the like.

Prior art U.S. Pat. No. 2,023,297, issued Dec. 3, 1935 to Vandegrift, illustrates a rotatable die that is shaped like a top, which is used for numbers games and the like. One of the indicia bearing surfaces is fixed to rotate with the top and a pair of additional indicia bearing elements is mounted to be relatively movable thereto, so that, when the top is spun, different number combinations are read across the upturned faces of the relatively movable elements/.

Prior art U.S. Pat. No. 2,311,453, issued Feb. 16, 1943 to McKeown, is for a game that comprises a spinning top body that is hexagonal in shape. The six faces thereof are provided with the markings of the six sides of a dice as shown. The cover is also provided with six inclined faces that are correspondingly marked to facilitate the readings of the tops sides from various positions. The top is spun upon a flat surface by means of the spinning stem.

Prior art U.S. Pat. No. 2,573,916, issued Nov. 6, 1951 to Loveday, provides a game top that consists of at least two separate elements, each of which bears game indicia, such as appears on a dice member. The elements together make up the top and function together as the top is spinning. The elements automatically separate when the top falls over upon completion of spinning. When so separated each element exposes upwardly an indicia bearing face.

Prior art U.S. Pat. No. 2,794,644, issued Jun. 4, 1957 to Johnson, shows a chance game device having the nature of a top. To obtain the chance display the device comprises a pair of hexagonal die members, each has a number indicia from one to six on its six faces. These die members also rotate while the game device rotates; but the device is so constructed so that the members will rotate haphazardly and independently so that they provide one or more chance displays when the device topples over.

What is needed is a new type of dice game played with a dice mounted with a central shaft for spinning the dice on a flat surface before the dice falls down and rolls.

SUMMARY OF THE INVENTION

An object of the present invention is to provide a dice mounted on a central shaft so that it spins and rolls thereby adding a new dimension to playing and gambling with dice and lessen the chance of cheating possible when throwing the dice from the palm of the hand.

Another object of the present invention is to provide a central shaft to spin the dice that requires developing a manual dexterity and skill in spinning the dice for longer or shorter spins and more even spins.

One more object of the present invention is to provide a dice that is slidable on central shaft, thereby altering the spin and balance properties of the system.

A further object of the present invention is to provide a betting surface bearing visual indications of the numbers on the faces of the dice piece and providing a variety of betting positions on the betting surface for placing betting pieces with an indication of payout odds for each of the betting positions including a betting board with a player bank space to allow a player to be a bank instead of the house when the player chooses to do so.

An added object of the present invention is to provide a smooth horizontal spinning surface capable of receiving the spinning dice piece on the vertical shaft thereon.

An additional object of the present invention is to provide a cover so that the players can hear the dice spinning and rolling but not see it, thereby adding a new dimension of excitement and anticipation to the game as well as enabling players to develop listening skills to try and predict the number on the dice.

A further object of the present invention is to provide a container below the horizontal spinning surface, bearing a quantity of sound absorbing material therein, making it more difficult to guess the outcome of the rolled dice.

In brief, a dice game system that has a spinning and rolling dice. The system comprises a dice piece, a vertical shaft, a betting surface, a horizontal spinning surface, a cover, and a container.

The dice piece has a top surface and a bottom surface with a circular perimeter and a vertical center hole through the dice piece from the top surface to the bottom surface. The dice piece also has six evenly spaced number bearing faces, which are adjacent to each other and positioned vertically around the perimeter of the dice piece, each of the number bearing faces has a visual representation of a different number.

The vertical shaft is longer than the height of the dice piece and is structured to fit within the vertical center hole with a tight slidable friction fit. The length of the vertical shaft allows for an upper finger-grasping portion of the vertical shaft to protrude above the dice piece. The length of the vertical shaft allows also a for lower spin point portion of the vertical shaft, having an end spin point, to protrude below the dice piece. The vertical shaft is capable of sliding within the vertical opening of the dice piece to alter the length of the upper finger-grasping portion and the lower spin point portion to vary the spin and balance properties of the system. The vertical shaft is capable of being grasped by a player on the upper finger-grasping portion and capable of spinning in response to a twisting force applied to the upper finger-grasping portion. The dice piece is capable of spinning on the spin point until the spinning motion slows and the dice piece lowers so that the circular perimeter of the bottom surface and the spin point are both in contact with an external horizontal surface. The dice piece spins rotating on the circular perimeter until it stops and falls on one of the number bearing faces with the opposite number bearing face facing upwardly to indicate a playable number on the face.

The betting surface bears visual indications of the numbers on the faces of the dice piece and provides a variety of betting positions on the betting surface for placing betting pieces with an indication of payout odds for each of the betting positions.

The smooth horizontal spinning surface is capable of receiving the spinning dice piece on the vertical shaft thereon and has a cover removably placeable over the spinning surface. The cover is capable of confining the limits of movement of the spinning dice piece and vertical shaft, concealing the movement of the spinning dice piece and vertical shaft, and then be lifted to reveal the playable number after motion has stopped.

A container is located below the horizontal spinning surface, which bears a quantity of sound absorbing material therein. The container is capable of fitting within an opening in a horizontal table surface so that the container rests below the table surface and the horizontal spinning surface is positioned above the horizontal table surface. The horizontal table surface is capable of receiving the betting surface thereon.

An advantage of the present invention is to adding a new dimension to playing and gambling.

Another advantage of the present invention is to lessen the chance of cheating.

An additional advantage of the present invention is to provide a way to develop manual dexterity and skill.

One more advantage of the present invention is to provide variable spin properties.

Yet another advantage of the present invention is to provide add excitement and anticipation in betting.

Still another advantage of the present invention is to help develop listening skills.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

In FIGS. 1–9, a dice game system that has a spinning and rolling dice 20.

Figure 1:
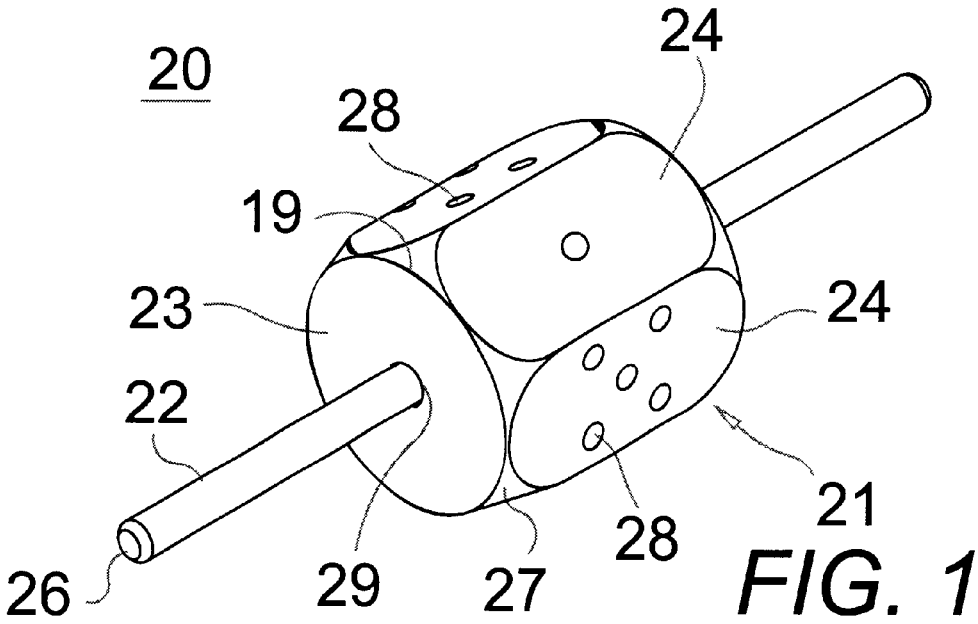
FIG. 1 is a perspective view of the dice piece mounted on a central spinning post.
Figure 2:
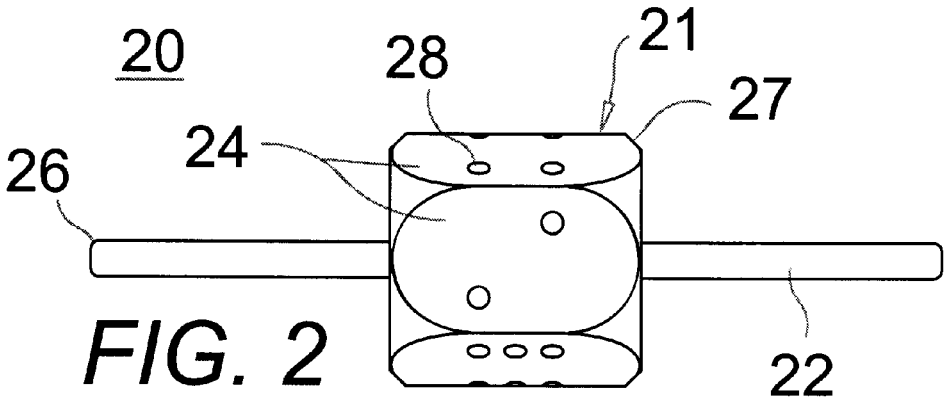
FIG. 2 is a side elevational view of the dice piece mounted on a central spinning post.
Figure 3:
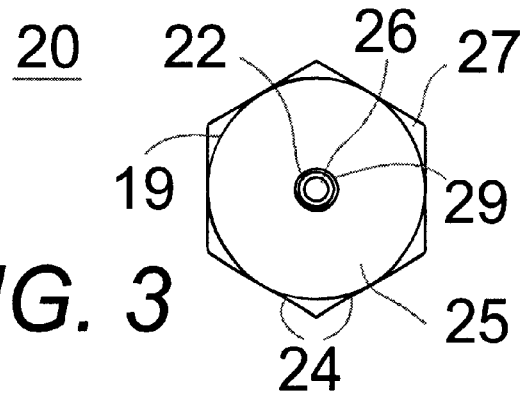
FIG. 3 is an end elevational view of the dice piece mounted on a central spinning post.
Figure 7:
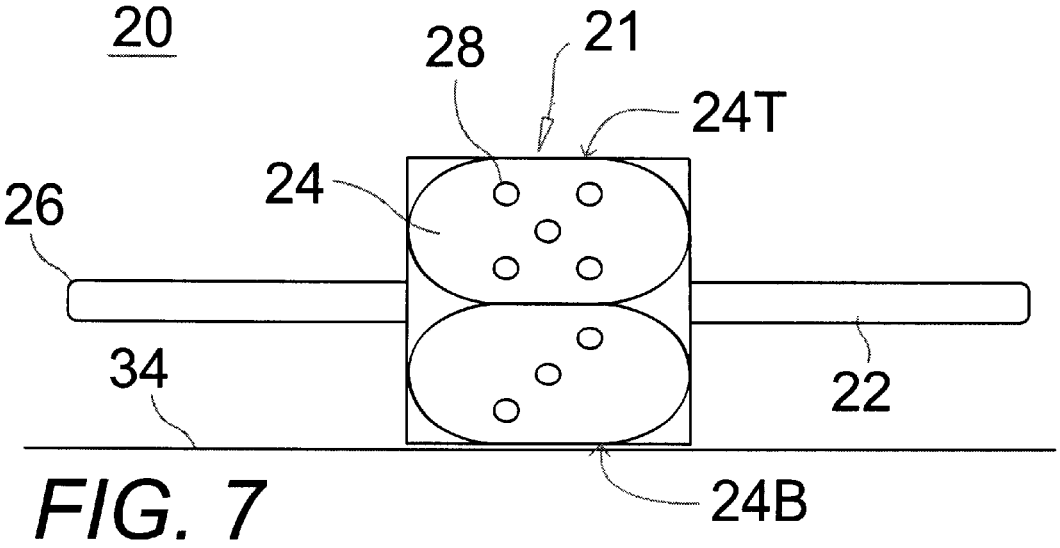
FIG. 7 is a side elevational view of the spinning dice of the present invention on the spinning platform at rest on one of the faces of the dice with the opposite upward pointing face showing the playable number.

The system comprises a dice piece 21 that has a top surface 25 and a bottom surface 23 with a circular perimeter 19 and a vertical center hole 29 through the dice piece 21 from the top surface 25 to the bottom surface 23 and a series of adjacent number bearing faces 24, preferably six faces, positioned vertically around the perimeter of the dice piece 21 (as shown in FIG. 3), each of the six evenly spaced number bearing faces 24 having a visual representation 28 of a different number (as shown in FIGS. 1,2 and 7).

Figure 4:
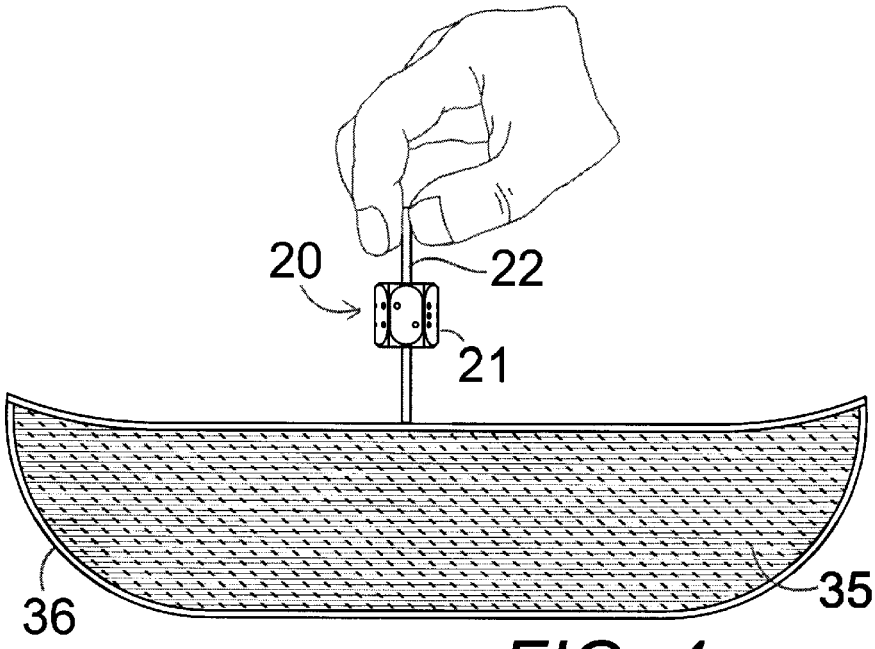
FIG. 4 is a side elevational view in partial section of the spinning dice of the present invention being held in the fingers of the player on the spinning platform showing sound absorbing material in the bowl beneath the platform.
Figure 6:
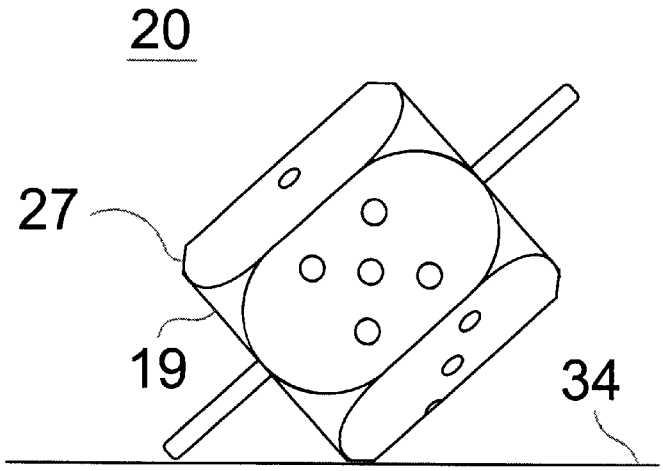
FIG. 6 is a side elevational view of the spinning dice of the present invention on the spinning platform in a second spinning position spinning around the bottom rim of the dice which takes place between the vertical spinning and coming to rest on one of the faces of the dice.

The system further comprises a vertical shaft 22 longer than the height of the dice piece 21. The vertical shaft 22 is structured to fit within the vertical center hole 29 (as shown in FIGS. 1–3) with a tight slidable friction fit, so that an upper finger grasping portion of the vertical shaft 22 protrudes above the dice piece 21 and a lower spin point portion of the vertical shaft 22, having an end spin point 26, protrudes below the dice piece 21, wherein the upper and lower functions are preferably reversible. The vertical shaft 22 is capable of being grasped by a player on the upper finger-grasping portion (as shown in FIG. 4) and capable of spinning in response to a twisting force applied to the upper finger-grasping portion. The dice piece 20 is capable of spinning on the spin point 26 until the spinning motion slows and the dice piece 20 lowers so that the circular perimeter 19 of the bottom surface 23 and the spin point 26 are both in contact with an external horizontal surface 34 (as shown in FIG. 6). The dice piece 20 spins rotating on the circular perimeter 19 until it stops and the dice piece 20 falls on one of the number bearing faces 24B with the opposite number bearing face 24T facing upwardly to indicate a playable number 28 on the face 24T (as shown in FIG. 7). The vertical shaft 22 is capable of sliding within the vertical opening 29 of the dice piece 21 to alter the length of the upper finger grasping portion and the lower spin point portion to vary the spin and balance properties of the system.

Figure 8:
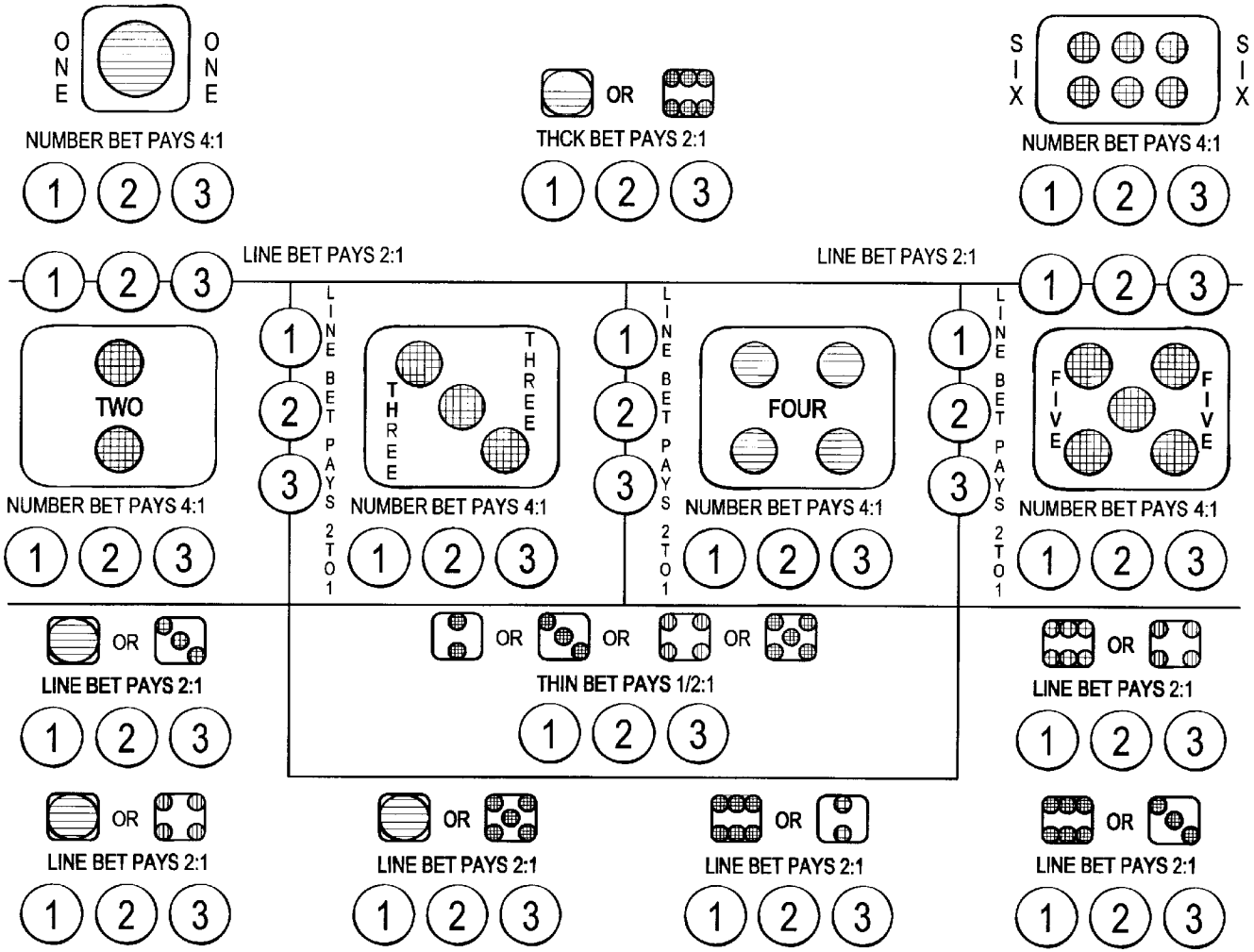
FIG. 8 is a top plan view of the layout for the betting board for the spinning dice game of the present invention.

The dice game system also comprises a betting surface (as shown in FIG. 8) that bears visual indications of the numbers on the faces of the dice piece and provides a variety of betting positions on the betting surface for placing betting pieces on a variety of outcomes of the roll, including combinations of outcomes, with an indication of payout odds for each of the betting positions.

Figure 5:
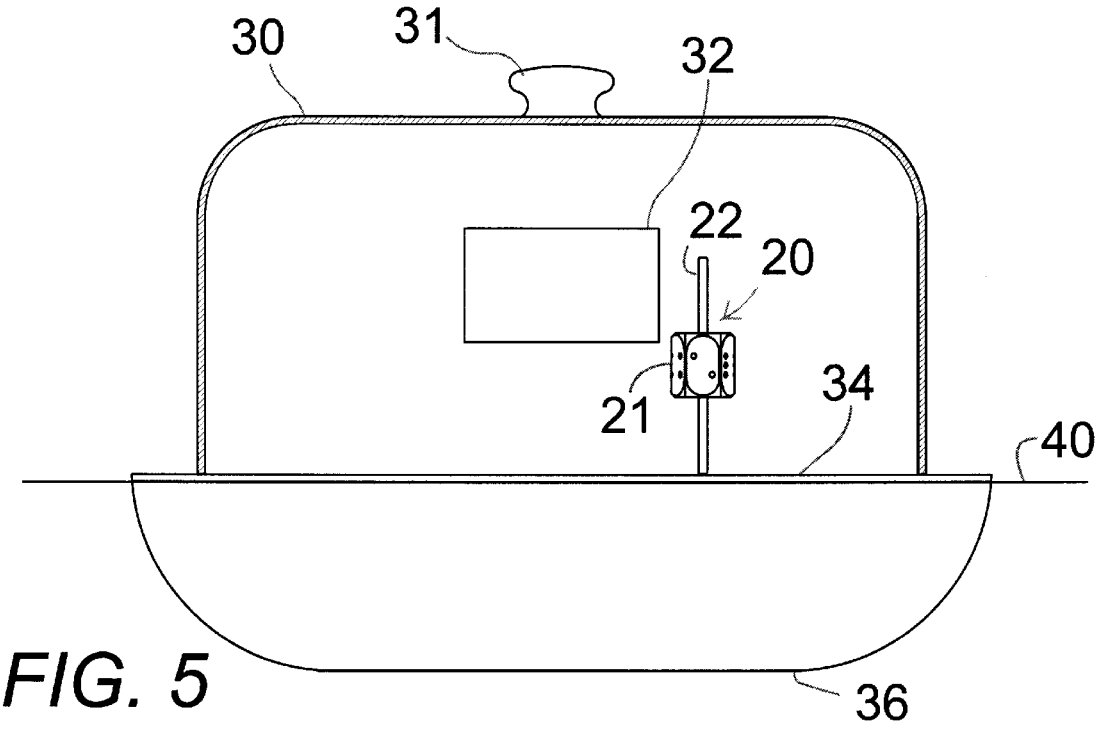
FIG. 5 is a side elevational view in partial section of the spinning dice of the present invention on the spinning platform with the bowl recessed in a table top and a cover over the platform.

The dice game system further comprises a smooth horizontal spinning surface 34 capable of receiving the spinning dice piece 20 on the vertical shaft 22 thereon and a cover 30 removably placeable over the spinning surface 34. The cover 30 is capable of confining the limits of movement of the spinning dice piece 20 and vertical shaft 22. The cover 30 is capable of concealing the movement of the spinning dice piece 20 and vertical shaft 22 (as shown in FIG. 5). The cover 30 is also capable being of lifted to reveal the playable number 28 on the exposed face 24T after motion has stopped. Alternately a door 32 may be opened on the cover 30 to reveal the outcome.

The dice game system also comprises a container 36 below the horizontal spinning surface 34, the container bearing a quantity of sound absorbing material 35 therein (as shown in FIG. 4). The container 36 is capable of fitting within an opening in a horizontal table surface 40 so that the container 36 rests below the table surface 40 and the horizontal spinning surface 34 is positioned above the horizontal table surface 40 (as shown in FIG. 5). The horizontal table surface 40 being capable of receiving the betting surface thereon.

Figure 9:
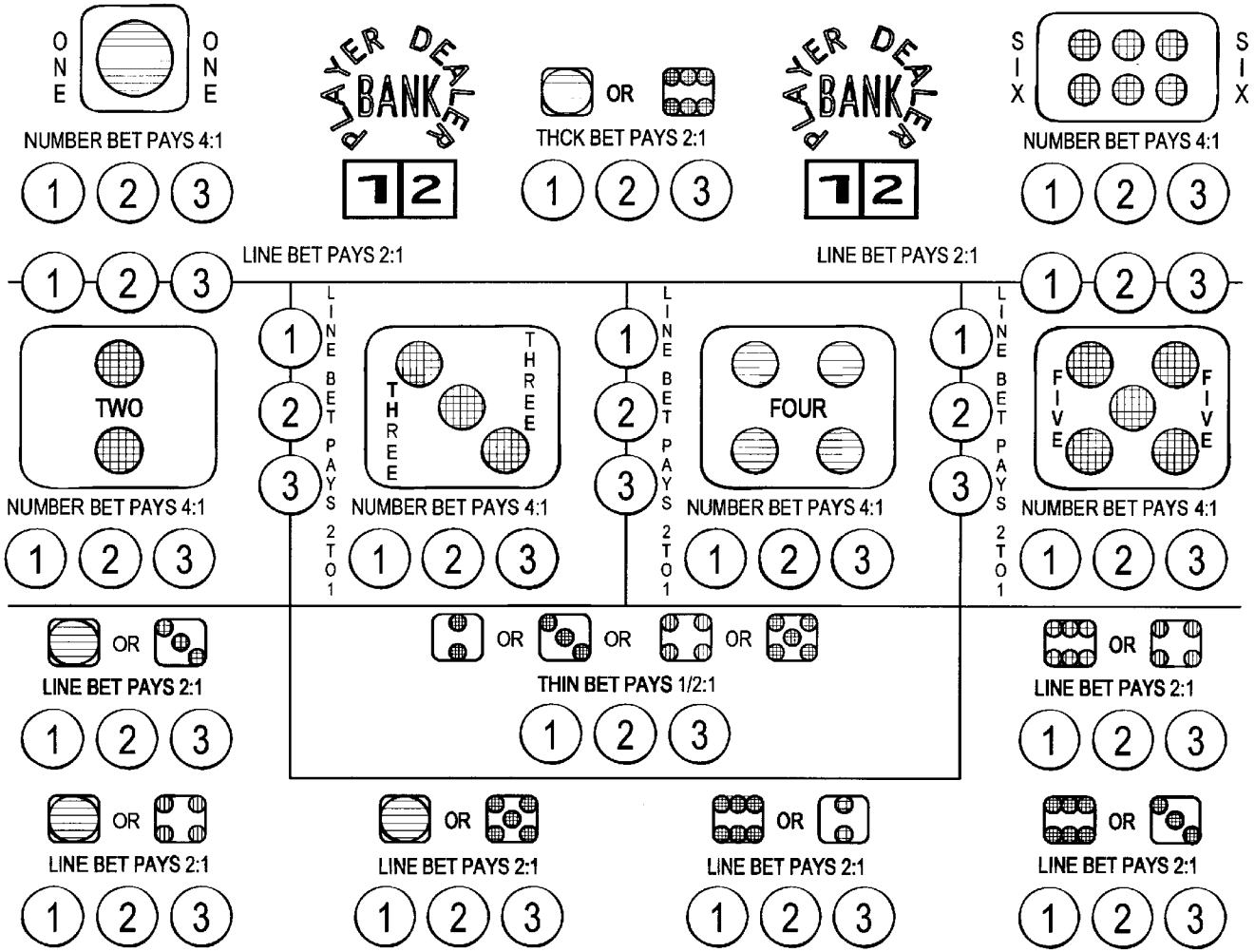
FIG. 9 is a top plan view of the layout for an alternate betting board for the spinning dice game of the present invention with a player bank space added.

In FIGS. 8 and 9, the betting board for the spinning dice game of the present invention has indications for the six numbers on the dice and spaces for betting shown by the circled numbers 1, 2, and 3 which provide betting spaces for three players. In a regulation board there would preferably be many more betting spaces for many players. Various combinations of bets may be placed on the board for various payoffs indicated on the board based on the odds of winning. In FIG. 9 two player bank spaces are added at the top center of the board which may be different colors. This enables the player to be a bank instead of the house when the player chooses to do so. The player places a large amount of money in the player bank space to cover all bets made by other players.

The dice game system may also be represented in a visual display format programmed to simulate the dice game system, so that it can be played on a video game or the world wide web or similar media.

In practice, the players would place the container 36 within an opening in a horizontal table surface 40 so the container 36 would rest below the table surface 40 and the horizontal spinning surface 34 would be positioned above the horizontal table surface 40 (as shown in FIG. 5). The container 36 would then be filled with a quantity of sound absorbing material 35 therein (as shown in FIG. 4), and the horizontal spinning surface 34 would be positioned above the horizontal table surface 40 (as shown in FIG. 5). A player would then alter the length of the upper finger grasping portion and the lower spin point portion to vary the spin and balance properties of the system by sliding the vertical shaft 22 within the vertical opening 29 of the dice piece 21.

The vertical shaft 22 is then capable of being grasped by a player on the upper finger grasping portion (as shown in FIG. 4) and spinning on its spin point 26 in response to a twisting force applied to the upper finger grasping portion. The cover 30 is placed over the container 36 to obstruct the player's view of the dice piece 20 (as shown in FIG. 5). The dice piece 20 then spins on the spin point 26 until the spinning motion slows and the dice piece 20 lowers so that the circular perimeter 19 of the bottom surface 23 and the spin point 26 are both in contact with an external horizontal surface 34 (as shown in FIG. 6). The dice piece 20 spins rotating on the circular perimeter 19 until it stops falls on one of the number bearing faces 24B with the opposite number bearing face 24T facing upwardly to indicate a playable number 28 on the face 24T (as shown in FIG. 7). The players would remove the cover 30 by grasping the handle 31 and lifting the cover 30 to expose the playable number 28 on the face 24T. The players would then compare the playable number 28 on the face 24T of the dice piece 20 to their bets placed on the betting surface (shown in FIG. 8).

Provision may also be made for a "buy" bet by having one player place a button on top of another player's chips to bet that the number the other player is betting on will not come out on the dice.

It is understood that the preceding description is given merely by way of illustration and not in limitation of the invention and that various modifications may be made thereto without departing from the spirit of the invention as claimed.

What is claimed is:

1. A dice game system having a spinning and rolling dice, the system comprising:

a dice piece having a top surface and a bottom surface with a circular perimeter and a vertical center hole through the dice piece from the top surface to the bottom surface and a series of adjacent number bearing faces positioned vertically around the perimeter of the dice piece, each of the number bearing faces having a visual representation of a different number;

a vertical shaft longer than the height of the dice piece, the vertical shaft structured to fit within the vertical center hole with a tight slidable friction fit, so that an upper finger grasping portion of the vertical shaft protrudes above the dice piece and a lower spin point portion of the vertical shaft, having an end spin point, protrudes below the dice piece, and the vertical shaft is adapted for being grasped by a player on the upper finger grasping portion and adapted for spinning in response to a twisting force applied to the upper finger grasping portion and the dice piece is adapted for spinning on the spin point until the spinning motion slows and the dice piece lowers so that the circular perimeter of the bottom surface and the spin point are both in contact with an external horizontal surface and the dice piece spins rotating on the circular perimeter until it stops and the dice piece falls on one of the number bearing faces with the opposite number bearing face facing upwardly to indicate a playable number on the face, the vertical shaft being adapted for sliding within the vertical opening of the dice piece to alter the length of the upper finger grasping portion and the lower spin point portion to vary the spin and balance properties of the system;

a betting surface bearing visual indications of the numbers on the faces of the dice piece and providing a variety of betting positions on the betting surface for placing betting pieces with an indication of payout odds for each of the betting positions u;

a smooth horizontal spinning surface adapted for receiving the spinning dice piece on the vertical shaft thereon and a cover removably placeable over the spinning surface, the cover being adapted for confining the limits of movement of the spinning dice piece and vertical shaft, the cover being adapted for concealing the movement of the spinning dice piece and vertical shaft, and the cover being adapted for lifting to reveal the playable number after motion has stopped.

2. The dice game system of claim 1 wherein the dice piece has six evenly spaced number bearing faces.

3. The dice game system of claim 1 further comprising a container below the horizontal spinning surface, the container bearing a quantity of sound absorbing material therein.

4. The dice game system of claim 3 wherein the container is adapted for fitting within an opening in a horizontal table surface so that the container rests below the table surface and the horizontal spinning surface is positioned above the horizontal table surface, the horizontal table surface being adapted for receiving the betting surface thereon.

5. The dice game system of claim 1 wherein the dice game system is represented in a visual display format programmed to simulate the dice game system.

* * * * *